US010673176B1

(12) United States Patent
Chen

(10) Patent No.: US 10,673,176 B1
(45) Date of Patent: Jun. 2, 2020

(54) SIGNAL CONNECTOR WITH ELASTIC CLAMPING PLATES AND TO-BE-PRESSED-AGAINST POSTS FOR ENSURING SECURE CONNECTION AND WATERTIGHTNESS

(71) Applicants: SIMULA TECHNOLOGY INC., Taoyuan (TW); Comark LLC, Milford, MA (US)

(72) Inventor: Shih-Jui Chen, Taoyuan (TW)

(73) Assignees: SIMULA TECHNOLOGY INC., Taoyuan (TW); COMARK LLC, Milford, MA (US)

( * ) Notice: Subject to any disclaimer, the term of this patent is extended or adjusted under 35 U.S.C. 154(b) by 0 days.

(21) Appl. No.: 16/278,791

(22) Filed: Feb. 19, 2019

(51) Int. Cl.

| | |
|---|---|
| ***H01R 13/40*** | (2006.01) |
| ***H01R 13/52*** | (2006.01) |
| ***H01R 4/28*** | (2006.01) |
| ***H01R 24/60*** | (2011.01) |
| ***H01R 13/504*** | (2006.01) |
| ***H01R 13/6581*** | (2011.01) |

(52) U.S. Cl.
CPC ..... *H01R 13/5202* (2013.01); *H01R 4/28* (2013.01); *H01R 13/504* (2013.01); *H01R 13/521* (2013.01); *H01R 13/6581* (2013.01); *H01R 24/60* (2013.01)

(58) Field of Classification Search
CPC .... H01R 4/28; H01R 13/5202; H01R 13/504; H01R 13/521; H01R 13/6581; H01R 24/60
USPC ..... 439/92, 108, 587, 660
See application file for complete search history.

(56) References Cited

U.S. PATENT DOCUMENTS

| | | | | |
|---|---|---|---|---|
| 6,913,494 | B2 * | 7/2005 | Ward | H01R 13/4365 439/352 |
| 7,465,185 | B2 * | 12/2008 | Tyler | H01R 13/506 439/352 |
| 7,594,827 | B2 * | 9/2009 | Takamoto | A63F 13/02 439/660 |
| 8,794,992 | B2 * | 8/2014 | Hsu | H01R 13/5213 439/353 |
| 8,801,471 | B2 * | 8/2014 | Zhu | H01R 13/6271 439/357 |

* cited by examiner

*Primary Examiner* — Khiem M Nguyen
(74) *Attorney, Agent, or Firm* — Bacon & Thomas, PLLC

(57) ABSTRACT

A signal connector with elastic clamping plates and to-be-pressed-against posts for ensuring secure connection and watertightness includes a connector socket and a connector plug. The connector socket has a base insulating body provided with: plural base connection terminals, two to-be-pressed-against posts, and a longitudinal conical portion and plural transverse conical portions for dividing the base connection terminals into rows. The connector plug has a head insulating body provided with: plural head connection terminals, two elastic clamping plates, and a longitudinal insertion groove for accommodating the exposed head connection terminals and, when the connector socket and plug are connected, for accommodating the longitudinal and transverse conical portions, too. Each elastic clamping plate can press elastically and tightly against the corresponding to-be-pressed-against post to prevent unintended displacement between the connector socket and plug, and water seeping into the signal connector can be guided out by the longitudinal and transverse conical portions.

16 Claims, 8 Drawing Sheets

SIGNAL CONNECTOR WITH ELASTIC CLAMPING PLATES AND TO-BE-PRESSED-AGAINST POSTS FOR ENSURING SECURE CONNECTION AND WATERTIGHTNESS

FIELD OF THE INVENTION

The present invention relates to a signal connector and more particularly to one with elastic clamping plates and to-be-pressed-against posts for ensuring secure connection, and hence watertightness, between the connector socket and the connector plug.

BACKGROUND OF THE INVENTION

A signal connector, which refers to any connecting element applied to an electronic or electric device to transmit data or electric signals, can be viewed as a bridge through which signals are transmitted from one such device to another. It follows that the production quality of a signal connector is critical to the reliability of current or data transmission between the electronic or electric devices it connects; more specifically, whether the connected electronic or electric devices can work consistently as designed hinges on the production quality and stability of the signal connector. Currently, depending on design requirements, different kinds of electric or electronic devices (e.g., home appliances, smartphones, and industrial servers) are respectively equipped with different signal connectors for receiving electric or data signals. While each electric or electronic device is enclosed in a casing for protecting the various precision electronic components inside the device, or more particularly for preventing dust and moisture from the outside from contaminating the precision electronic components, a signal connector applied to the device is seldom mounted thereon in a watertight manner. Therefore, once the electric or electronic device is used in a humid environment, ambient moisture is bound to seep into the device through the gap between the device and the signal connector and may end up in the precision electronic components inside the device, causing a short circuit or corrosion. In view of the above, waterproofness has in recent years been an essential feature on the signal connector market.

Generally, the waterproof design of a signal connector is focused on the internal connection terminals, which are used to transmit electric or data signals. These connection terminals are typically inserted into, and thereby mounted on, the signal connector. To ensure waterproofness of such a signal connector, it was common practice to perform an adhesive dispensing operation on the connection terminals of the signal connector sequentially during the manufacturing process, with a view to sealing the insertion gaps corresponding to where the connection terminals are inserted into the signal connector. The adhesive dispensing operation is indeed effective in enhancing the "internal" waterproofness of the signal connector, but "external" waterproofness is overlooked, as explained below with reference to a conventional signal connector. FIG. 1 shows the socket portion 1 of a conventional signal connector, wherein the socket portion 1 includes an insulating base 11 and a plurality of connection terminals 12 inserted in the insulating base 11. During the manufacturing process of the conventional signal connector, the interior of the insulating base 11 is coated with a waterproofing adhesive, which seeps into, and seals when solidified, the insertion gap between the middle section of each connection terminal 12 and the inner wall of the insulating base 11 to waterproof the conventional signal connector as required.

While watertightness is achieved by the waterproofing adhesive sealing the insertion gaps between the connection terminals 12 and the inner wall of the insulating base 11, this watertightness leaves much to be desired. Should the conventional signal connector become dripping wet when the electric or electronic device to which the conventional signal connector is applied is used outdoors, the water clinging to and remaining on the top side of the insulating base 11 may still seep into the conventional signal connector through the gap between the socket portion 1 and the plug portion (not shown) of the conventional signal connector without difficulty, resulting in a short circuit between adjacent connection terminals 12, if not damage to the electric or electronic device itself. Hence, it is an important issue for signal connector designers and manufacturers to devise a simple structure that, without incurring a significant increase in the production cost of the conventional signal connector, can effectively prevent water residue on the signal connector from entering the connector through the gap between its socket and plug portions, lest the connection terminals 12 be short-circuited. The very issue is addressed by the present invention.

BRIEF SUMMARY OF THE INVENTION

In light of, and in order to solve, the foregoing problem of a conventional signal connector (i.e., the water clinging to and remaining on a conventional signal connector is very likely to enter the signal connector through the gap between the socket portion and the plug portion, thus short-circuiting adjacent connection terminals inside the connector or even damaging the electric or electronic device to which the connector is applied), the inventor of the present invention incorporated years of practical experience in the development, design, and manufacture of various signal connectors into an extensive research, repeated tests, and numerous improvements and finally succeeded in developing a signal connector whose elastic clamping plates and to-be-pressed-against posts ensure secure connection and watertightness.

It is an objective of the present invention to provide a signal connector that uses elastic clamping plates and to-be-pressed-against posts to ensure secure connection and watertightness. The signal connector includes a connector socket and a connector plug. The connector socket includes a base insulating body, a plurality of base connection terminals, and two to-be-pressed-against posts. Each base connection terminal is fixedly provided in the base insulating body and has one end exposed from the front side of the base insulating body. The exposed ends of the base connection terminals are arranged on the base insulating body in a plurality of rows. The base insulating body includes a longitudinal conical portion and a plurality of transverse conical portions. The longitudinal conical portion has a conical cross section and is protrudingly provided on the front side of the base insulating body along the longitudinal direction of the base insulating body, thereby dividing the base connection terminals into a plurality of rows. The longitudinal conical portion has two corresponding sides each forming an inclined wall. The inclined walls have a first common side forming the conical ridge of the longitudinal conical portion and extend from the first common side toward their respective opposite sides in a sloping manner along the transverse direction of the base insulating body. The top ends of the same row of base connection terminals are exposed on the same inclined wall. The transverse conical portions, each having a conical cross section too, are protrudingly provided on the front side of the base insulating body along the transverse direction of the base insulating body. Each transverse conical portion has a first end connected to the corresponding inclined wall of the longitudinal conical portion and extends from the first end toward the opposite second end along the transverse direction of the base insulating body. Each transverse conical portion has two corresponding sides each forming a dividing wall. The dividing walls of each transverse conical portion have a second common side forming the conical ridge of the transverse conical portion and extend from the second common side toward their respective opposite sides in a sloping manner along the longitudinal direction of the base insulating body. The conical ridge of each transverse conical portion is higher than the top ends of the base connection terminals to divide each two adjacent base connection terminals in the same row. The to-be-pressed-against posts are fixed on the base insulating body, are adjacent to two opposite ends of the base insulating body respectively, and each have one end exposed from the base insulating body. The to-be-pressed-against posts are higher than the conical ridge of the longitudinal conical portion and the conical ridges of the transverse conical portions. The connector plug includes a head insulating body, a plurality of head connection terminals, and two elastic clamping plates. The head insulating body includes a longitudinal insertion groove concavely provided in the front side, and along the longitudinal direction, of the head insulating body to accommodate the exposed ends of the head connection terminals, which exposed ends are arranged in a plurality of rows. The longitudinal insertion groove matches the longitudinal conical portion and the transverse conical portions in configuration so that the longitudinal conical portion and the transverse conical portions can be inserted into the longitudinal insertion groove, thereby connecting the connector plug and the connector socket together. Once the connector socket and the connector plug are connected, each elastic clamping plate has one end pressing elastically and tightly against the periphery of the corresponding to-be-pressed-against post, and the elastic clamping and pressing force between each elastic clamping plate and the corresponding to-be-pressed-against post prevents the connector socket and the connector plug from displacement with respect to each other under the action of an external force (e.g., a shaking, wobbling, or swaying force). Thus, the connector socket and the connector plug remain securely connected, are not prone to forming a gap therebetween, and are effectively kept from getting loose with respect to each other. Should the signal connector become dripping wet, therefore, not only is it difficult for the water residue on the signal connector to find any gap to seep through between the connector socket and the connector plug, but also the inclined walls of the longitudinal conical portion and the dividing walls of the transverse conical portions will guide any water that does find, and seep through, a gap between the connector socket and the connector plug to flow out of the gap, thereby protecting adjacent base connection terminals or head connection terminals from forming a short circuit.

BRIEF DESCRIPTION OF THE SEVERAL VIEWS OF THE DRAWINGS

The design concept, structural features, and objectives of the present invention can be better understood by referring to the following detailed description of some illustrative embodiments and the accompanying drawings, in which.

DETAILED DESCRIPTION OF THE INVENTION

Figure 1:
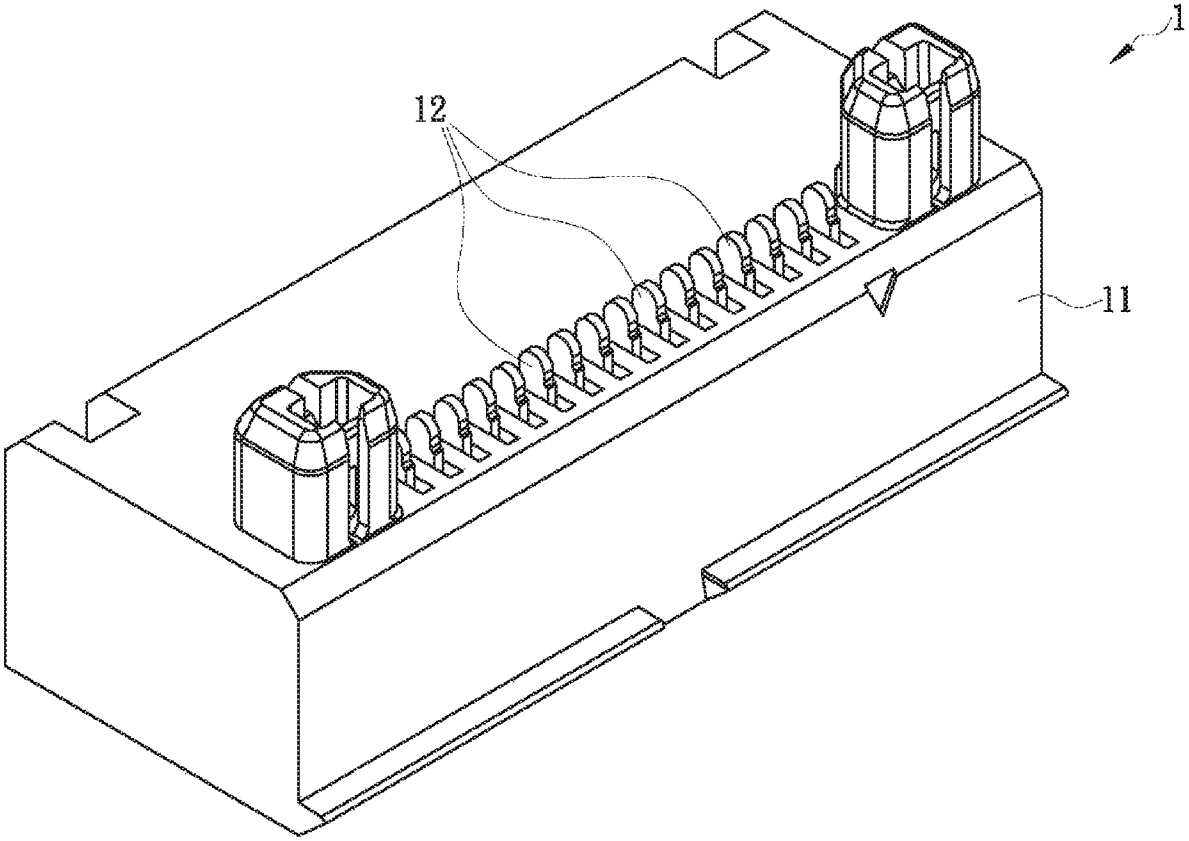
FIG. 1(Prior Art)
FIG. 1 is a perspective view of the socket portion of a conventional signal connector.
Figure 2:
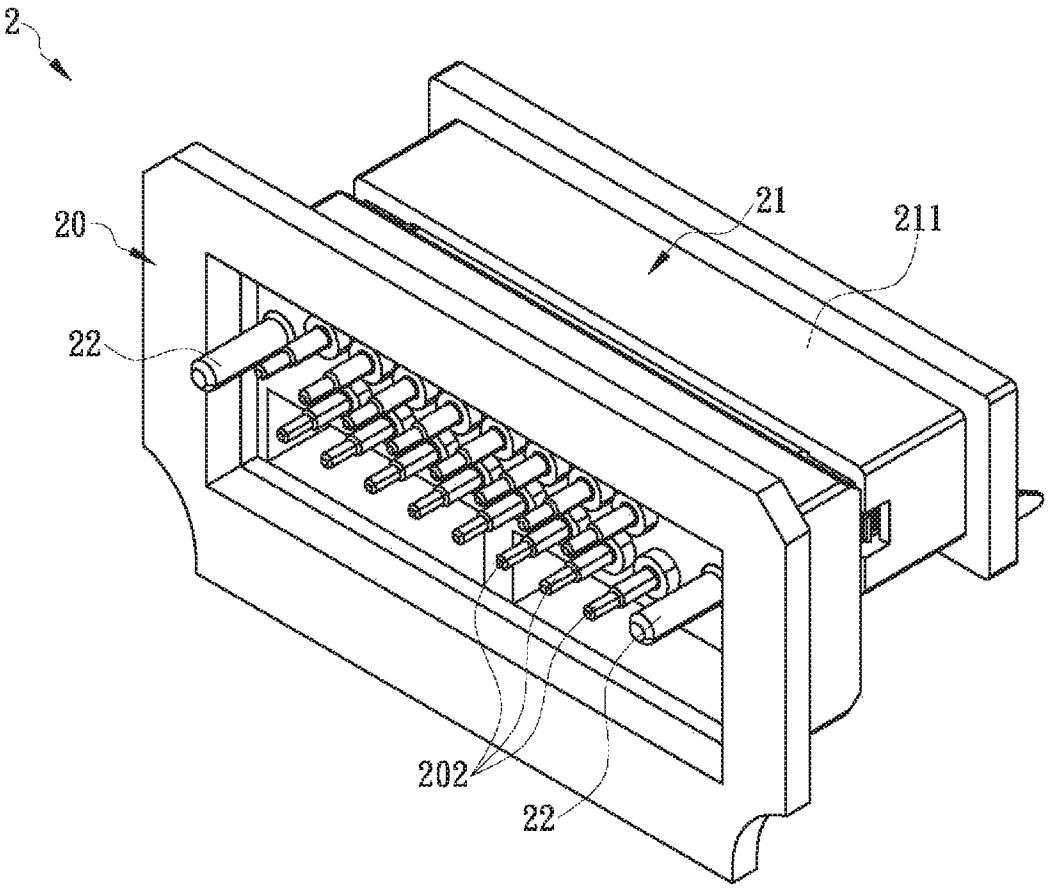
FIG. 2 is a perspective view of a signal connector according to the present invention, wherein the signal connector is in a connected state.
Figure 3:
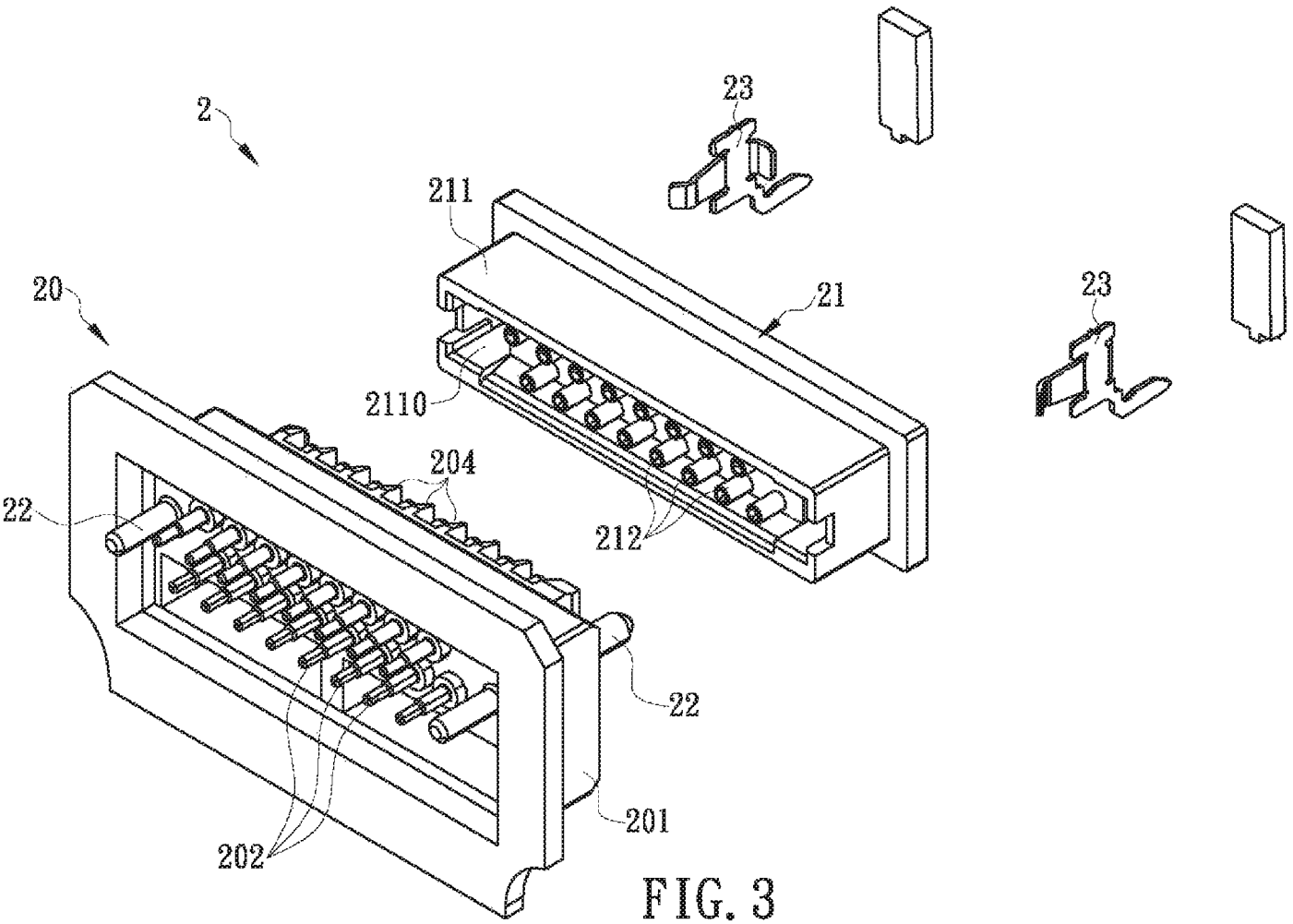
FIG. 3 is a partially exploded perspective view of the signal connector in FIG. 2.
Figure 4:
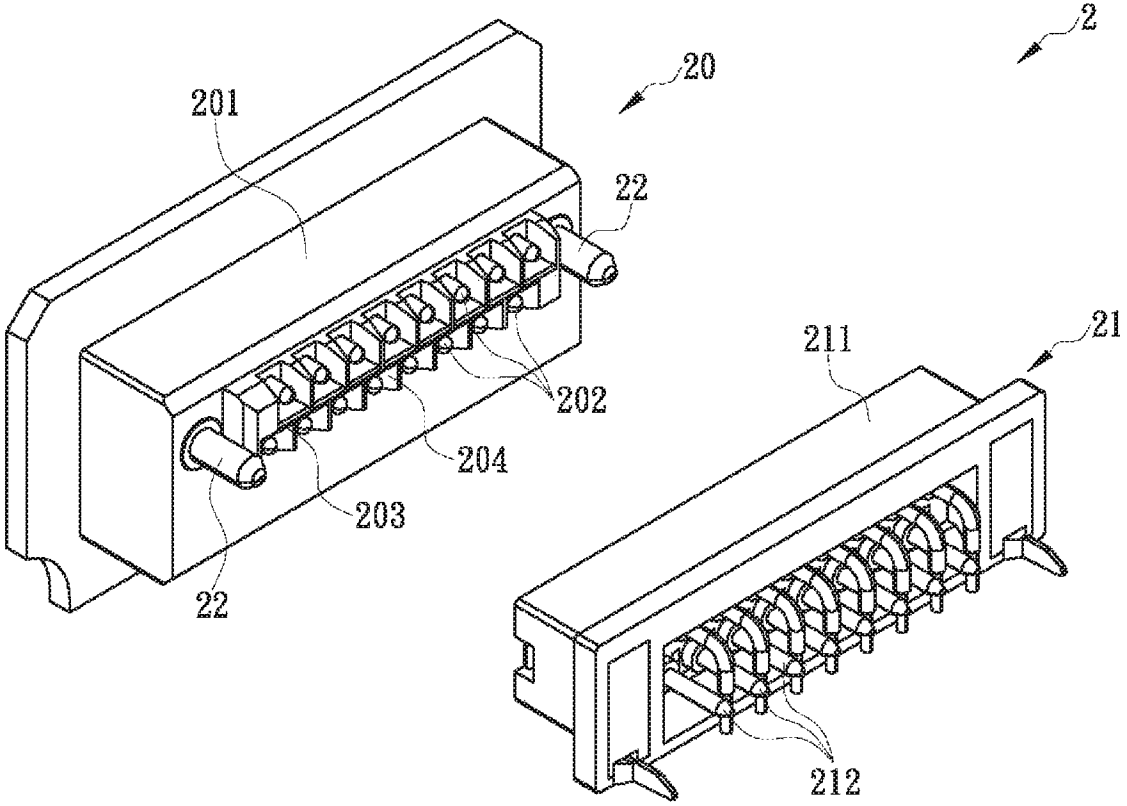
FIG. 4 is another perspective view of the signal connector in FIG. 2, showing the signal connector in an unconnected state.
Figure 5:
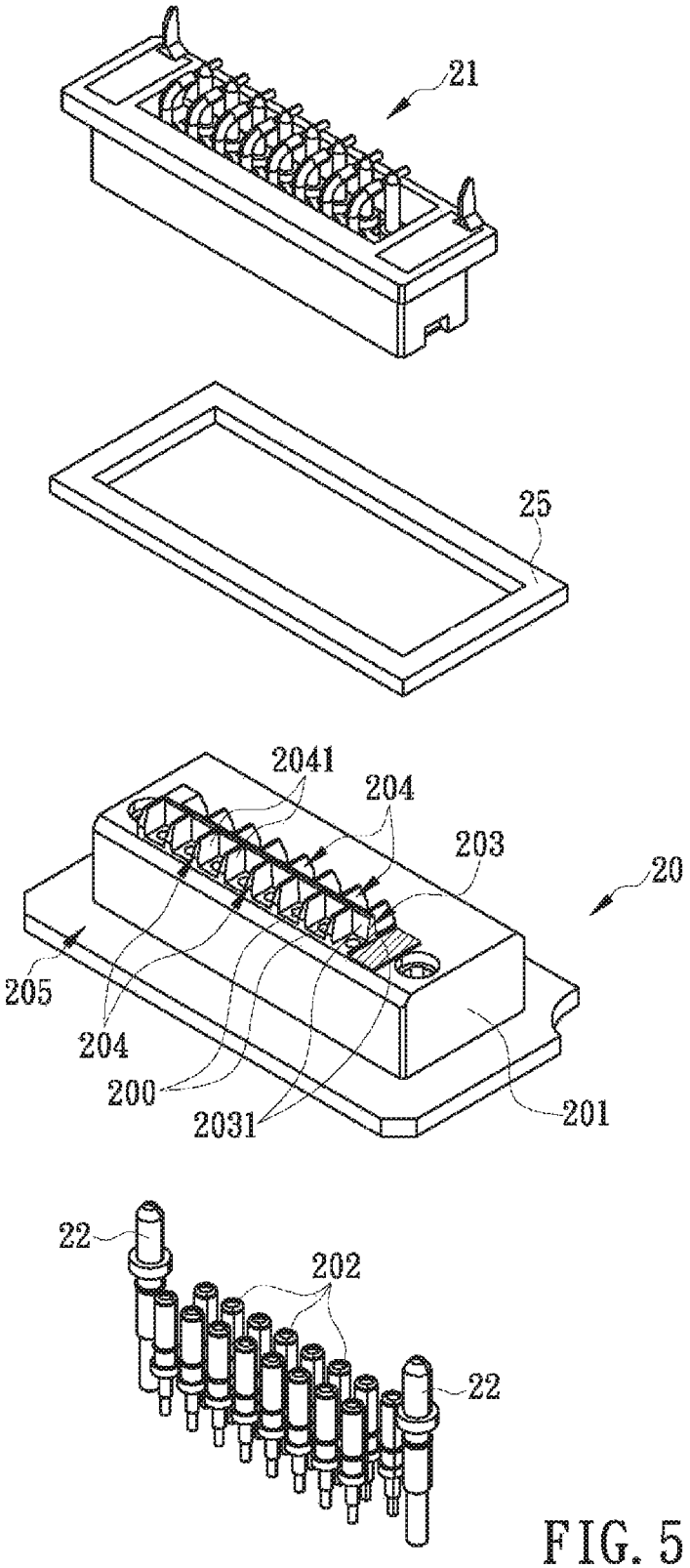
FIG. 5 is an exploded perspective view of the socket portion of the signal connector in FIG. 2.

To ensure waterproofness and effectiveness of a signal connector, it is crucial that the socket portion and the plug portion of the signal connector be so configured that, once the socket portion and the plug portion are put together, the connection between the two portions is secure enough to prevent relative displacement thereof when the signal connector is subjected to an external force (e.g., shaken, wobbled, or swayed), the goal being to "effectively prevent gap formation between the socket portion and the plug portion" so that ambient water is kept from entering the connected signal connector through any such gap. However, based on years of practical experience and the research and experiment conducted by the inventor of the present invention, it was found that the foregoing design considerations regarding the configuration of the socket portion and the plug portion are inadequate to ensure waterproofness of the signal connector. Apart from endeavoring to "avoid contact between ambient water (e.g., water residue on the signal connector) and the connection terminals inside the connector", it is equally, if not more, important to incorporate the concept of "guiding away the water residue on the signal connector" into the configuration of the socket portion and the plug portion while also considering such market factors as the volume and production cost of the signal connector. Understanding this, the inventor of the present invention integrated the two design concepts stated above into a repeated cycle of designing, manufacturing, testing, and improving and finally succeeded in developing a signal connector with elastic clamping plates and to-be-pressed-against posts for ensuring secure connection and watertightness. Please refer to FIG. 2 for the signal connector 2 according to a preferred embodiment of the present invention. The signal connector 2 includes a connector socket 20 and a connector plug 21. As shown in FIG. 3, the connector socket 20 includes a base insulating body 201, a plurality of base connection terminals 202, and two to-be-pressed-against posts 22. The base connection terminals 202 (each of which has a cylindrical configuration in this preferred embodiment but is not necessarily so configured in other embodiments) are fixedly provided in the base insulating body 201, wherein "being fixedly provided" can be implemented in many ways, such as by injection-molding the base insulating body 201 out of plastic and fixing the base connection terminals 202 in the base insulating body 201 at the same time, or by injection-molding the base insulating body 201 in advance, inserting the base connection terminals 202 fixedly into the base insulating body 201, and then sealing the insertion gap between each base connection terminal 202 and the base insulating body 201 with a waterproofing adhesive. The way to fixedly provide the base connection terminals 202 can be chosen according to practical needs, production cost, the desired ingress protection grade, and so on. In this preferred embodiment of the present invention, referring to FIG. 4, each base connection terminal 202 has one end exposed from the front side of the base insulating body 201 (i.e., the side of the base insulating body 201 that faces the lower right corner of FIG. 4), and the exposed ends of the base connection terminals 202 are arranged on the front side of the base insulating body 201 in a plurality of rows. Referring to FIG. 5, the base insulating body 201 includes a longitudinal conical portion 203 and a plurality of transverse conical portions 204. The longitudinal conical portion 203 has a conical cross section and is protrudingly provided on the front side of the base insulating body 201 (i.e., the side of the base insulating body 201 that faces the top side of FIG. 5) along the longitudinal direction of the base insulating body 201, thereby dividing the base connection terminals 202 into a plurality of rows. The longitudinal conical portion 203 further has two corresponding sides each forming an inclined wall 2031. The inclined walls 2031 have a common side that forms the conical ridge of the longitudinal conical portion 203, and from this common side the inclined walls 2031 extend toward their respective opposite sides in a sloping manner along the transverse direction of the base insulating body 201. The top ends of the same row of base connection terminals 202 are exposed from the same inclined wall 2031. The transverse conical portions 204, each having a conical cross section too, are protrudingly provided on the front side of the base insulating body 201 along the transverse direction of the base insulating body 201. Each transverse conical portion 204 has one end connected to the corresponding inclined wall 2031 of the longitudinal conical portion 203 and extends from this end toward the opposite end along the transverse direction of the base insulating body 201. Each transverse conical portion 204 further has two corresponding sides each forming a dividing wall 2041. The dividing walls 2041 of each transverse conical portion 204 have a common side that forms the conical ridge of the transverse conical portion 204, and from this common side the dividing walls 2041 extend toward their respective opposite sides in a sloping manner along the longitudinal direction of the base insulating body 201. The conical ridge of each transverse conical portion 204 is higher than the top ends of the base connection terminals 202 so as to separate each two adjacent base connection terminals 202 in the same row. The to-be-pressed-against posts 22 are fixed on the base insulating body 201 and are adjacent to two opposite ends of the base insulating body 201 respectively. Each to-be-pressed-against post 22 has one end exposed from the base insulating body 201 and is higher than the conical ridge of the longitudinal conical portion 203 and the conical ridges of the transverse conical portions 204.

In this preferred embodiment of the present invention, referring back to FIG. 2 and FIG. 3, the connector plug 21 includes a head insulating body 211, a plurality of head connection terminals 212, and two elastic clamping plates 23. The head insulating body 211 includes a longitudinal insertion groove 2110. The longitudinal insertion groove 2110 is concavely provided in the front side of the head insulating body 211 (i.e., the side of the head insulating body 211 that faces the lower left corner of FIG. 3) along the longitudinal direction of the head insulating body 211. The configuration of the longitudinal insertion groove 2110 matches those of the longitudinal conical portion 203 and of the transverse conical portions 204 on the base insulating body 201 so that the wall of the longitudinal insertion groove 2110 can be fitted around the longitudinal conical portion 203 and the transverse conical portions 204 (i.e., the longitudinal conical portion 203 and the transverse conical portions 204 can be inserted into the longitudinal insertion groove 2110) to connect the connector plug 21 and the connector socket 20 together. The head connection terminals 212 are fixedly provided in the head insulating body 211. Each head connection terminal 212 has one end exposed on the front side of the head insulating body 211, and the exposed ends of the head connection terminals 212 are arranged in the longitudinal insertion groove 2110 in a plurality of rows. Referring to FIG. 2, FIG. 3, FIG. 4, and FIG. 5, the elastic clamping plates 23 are fixed in the head insulating body 211 and are adjacent to two opposite ends of the head insulating body 211 respectively. Each elastic clamping plate 23 has one end exposed on the front side of the head insulating body 211 so that, once the connector socket 20 and the connector plug 21 are connected, referring to FIG. 6, not only does the exposed end of each base connection terminal 202 abut against the exposed end the corresponding head connection terminal 212 to bring the two corresponding connection terminals 202, 212 into a conducting state, in which electric or data signals can be transmitted between the two corresponding connection terminals, but also the exposed end of each elastic clamping plate 23 presses elastically and tightly against the periphery of the corresponding to-be-pressed-against post 22, in order for the elastic clamping and pressing force F between each elastic clamping plate 23 and the corresponding to-be-pressed-against post 22 to prevent the connector socket 20 and the connector plug 21 from displacement with respect to each other under the action of an external force (e.g., when shaken, wobbled, or swayed). It is thus ensured that the connector socket 20 and the connector plug 21 will stay securely connected and are effectively kept from forming a gap therebetween, let alone getting loose with respect to each other. When the exterior of the connected signal connector 2 becomes wet (e.g., with rain during outdoor use), the water clinging to and remaining on the exterior of the signal connector 2 is hindered from entering the signal connector 2 because a gap does not easily form between the connector socket 20 and the connector plug 21. Even if a gap is formed between the connector socket 20 and the connector plug 21 and allows ingress of water, the water will be guided by the inclined walls 2031 of the longitudinal conical portion 203 and the dividing walls 2041 of the transverse conical portions 204, flow down the inclined walls 2031 of the longitudinal conical portion 203 while being divided by the dividing walls 2041 of the transverse conical portions 204, run to the transverse lateral sides of the base insulating body 201 under the guidance of those walls, and exit the signal connector 2 through the gap where water ingress occurred in the first place. The foregoing design can effectively prevent any infiltrating water from forming a short circuit between adjacent base connection terminals 202 or head connection terminals 212 in the signal connector 2, thus protecting the electronic or electric device to which the signal connector 2 is applied from damage.

In this preferred embodiment of the present invention, referring again to FIG. 2, FIG. 3, FIG. 4, and FIG. 5, the water guiding function is enhanced by arranging the different rows of base connection terminals 202 in a staggered manner with respect to each other, and by arranging the transverse conical portions 204 between one row of base connection terminals 202 and the transverse conical portions 204 between the other row of base connection terminals 202 in a staggered manner with respect to each other too, with each base connection terminal 202 on one inclined wall 2031 corresponding in position to one transverse conical portion 204 on the other inclined wall 2031. Moreover, the conical ridges of the transverse conical portions 204 and the conical ridge of the longitudinal conical portion 203 are of the same height so that water will not stay on any step-like structure between the conical portions 203, 204. Also, the cross-sectional area of each transverse conical portion 204 in this preferred embodiment of the present invention is smaller than that of the longitudinal conical portion 203 to achieve a proper configuration with regard to the volume of the signal connector 2.

As stated above, the method by which the base connection terminals 202 (or the head connection terminals 212) in this preferred embodiment of the present invention are fixedly provided in the base insulating body 201 (or the head insulating body 211) is not limited to injection molding. As shown in FIG. 5, it is feasible for the base insulating body 201 (or the head insulating body 211) in another embodiment of the present invention to be penetrated by a plurality of base terminal grooves (or head terminal grooves) 200, wherein the top end of each base terminal groove 200 is exposed on the corresponding inclined wall 2031 of the longitudinal conical portion 203 (or the corresponding dividing wall 2041 of the corresponding transverse conical portion 204) and the bottom end of each base terminal groove 200 is exposed on a bottom portion of the base insulating body 201 so that the base connection terminals 202 can be inserted into the base insulating body 201 through the base terminal grooves 200 respectively.

Besides, the signal connector 2 includes a washer 25 in order to be locked in a watertight manner to the casing of the electric or electronic device where the signal connector 2 is to be mounted, with only a top portion of the signal connector 2 exposed through a connection port of the casing. With continued reference to FIG. 5, the base insulating body 201 is further provided with a washer groove 205 around its periphery. The configuration and dimensions of the washer groove 205 match those of the washer 25 so that the washer 25 can be mounted precisely in the washer groove 205 in a watertight manner and thus positioned around the periphery of the base insulating body 201. Once the signal connector 2 is mounted in the connection port of the casing of the intended electric or electronic device, the washer 25 is pressed tightly against an inner wall portion of the casing that is adjacent to the connection port.

Figure 6:
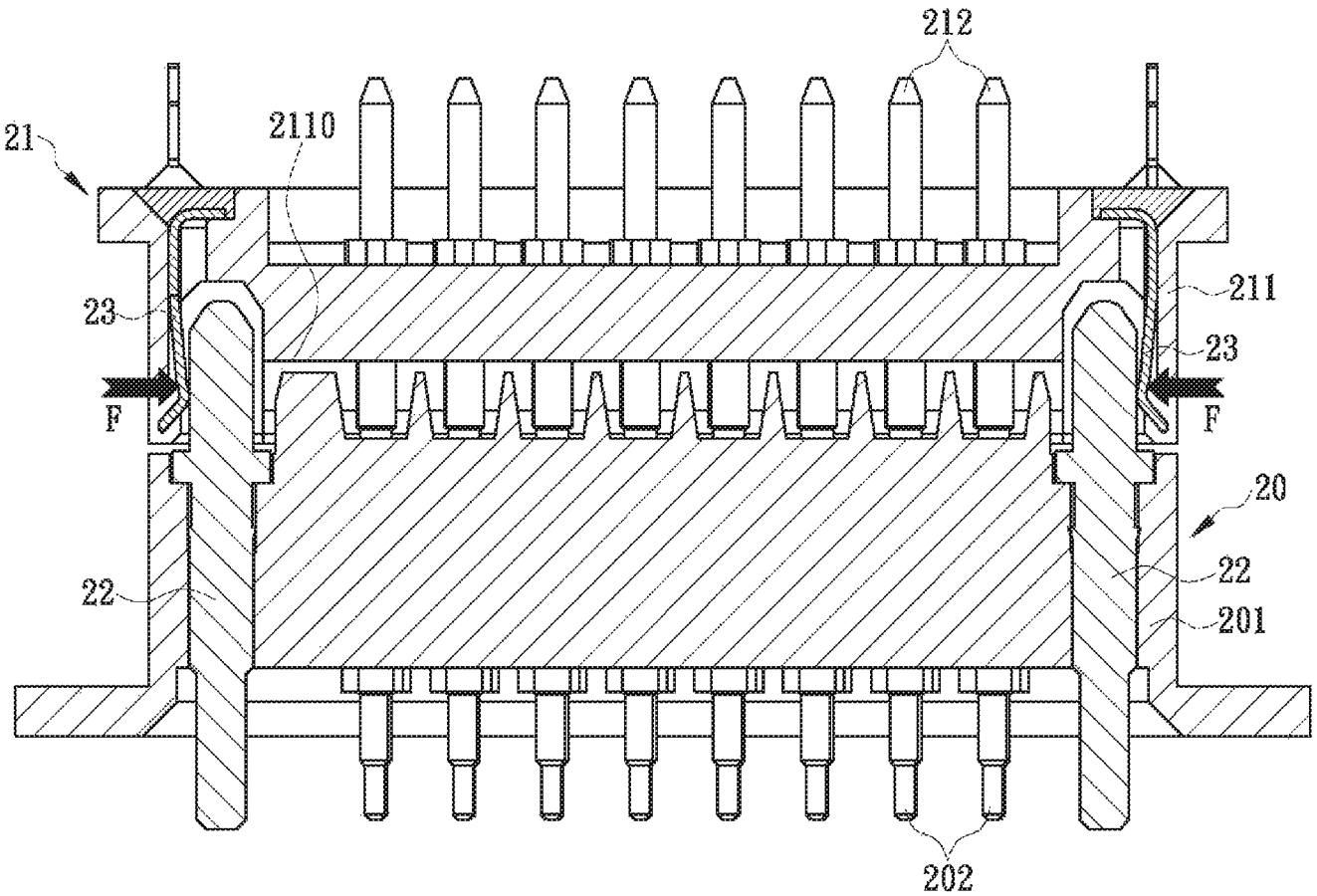
FIG. 6 is a longitudinal sectional view of the signal connector in FIG. 2, with the signal connector in the connected state.
Figure 7:
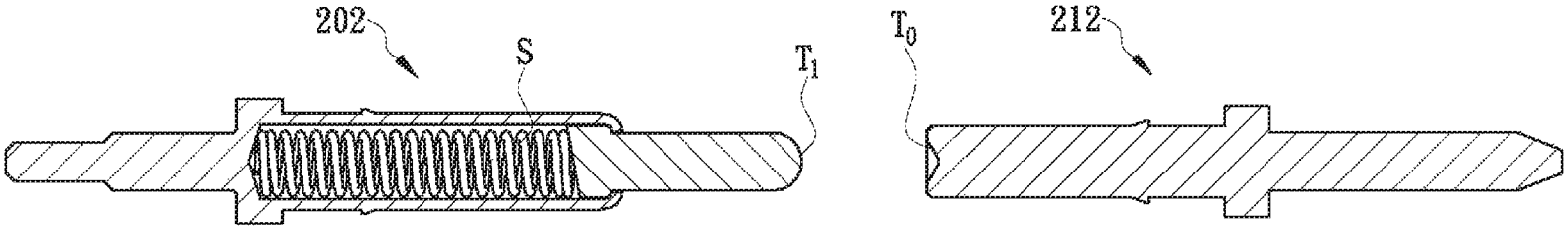
FIG. 7 is a longitudinal sectional view of a base connection terminal of the signal connector in FIG. 2 and the corresponding head connection terminal, wherein the connection terminals are in an unconnected state.
Figure 8:
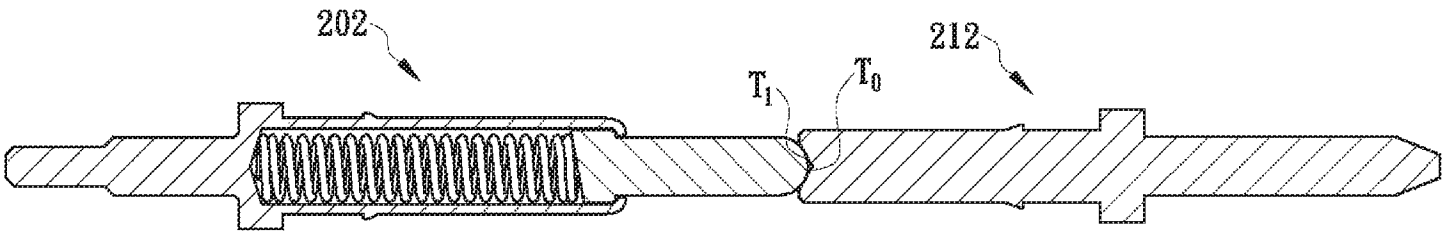
FIG. 8 is similar to FIG. 7 except that the connection terminals are in a connected state.

To ensure secure abutment, and hence stable transmission of electric or data signals, between the exposed end of each base connection terminal 202 and the exposed end of the corresponding head connection terminal 212 when the connector socket 20 and the connector plug 21 are connected as shown in FIG. 6, each base connection terminal 202 (or head connection terminal 212) is provided therein with an elastic element S as shown in FIG. 7 and FIG. 8. The elastic element S in each base connection terminal 202 (or head connection terminal 212) not only allows the exposed end of the base connection terminal 202 (or head connection terminal 212) to abut elastically against the exposed end of the corresponding head connection terminal 212 (or base connection terminal 202), but also is effective in absorbing the external force to which the connector socket 20 is subjected (e.g., a shaking, wobbling, or swaying force), making sure that the exposed end of the base connection terminal 202 (or head connection terminal 212) abuts securely against the exposed end of the corresponding head connection terminal 212 (or base connection terminal 202) to enable stable transmission of electric or data signals by the signal connector 2. Moreover, with continued reference to FIG. 7 and FIG. 8, each base connection terminal 202 (or head connection terminal 212) has a hemispherical convex end $T_1$ to abut against a curved concave end $T_0$ of the corresponding head connection terminal 212 (or base connection terminal 202) so that, when the connector socket 20 and the connector plug 21 are connected, the convex end $T_1$ of each base connection terminal 202 (or head connection terminal 212) will abut securely against, and be kept from displacement with respect to, the concave end $T_0$ of the corresponding head connection terminal 212 (or base connection terminal 202) to ensure stable transmission of electric or data signals. The convex ends and the concave ends have no negative effect on the transmission of electric or data signals.

While the invention herein disclosed has been described by means of specific embodiments, numerous modifications and variations could be made thereto by those skilled in the art without departing from the scope of the invention set forth in the claims.

What is claimed is:

1. A signal connector with elastic clamping plates and to-be-pressed-against posts for ensuring secure connection and watertightness, comprising:

a connector socket comprising a base insulating body and a plurality of base connection terminals, wherein each said base connection terminal is fixedly provided in the base insulating body and has an end exposed from a front side of the base insulating body, the exposed ends of the base connection terminals are arranged on the base insulating body in a plurality of rows, and the base insulating body comprises:

a longitudinal conical portion with a conical cross section, wherein the longitudinal conical portion is protrudingly provided on the front side of the base insulating body along a longitudinal direction of the base insulating body and thereby divides the base connection terminals into a plurality of rows, the longitudinal conical portion has two corresponding sides each forming an inclined wall, the inclined walls have a first common side forming a conical ridge of the longitudinal conical portion and extend from the first common side toward respective opposite sides of the inclined walls in a sloping manner along a transverse direction of the base insulating body, and top ends of a same said row of base connection terminals are exposed on a same said inclined wall;

a plurality of transverse conical portions each having a conical cross section, wherein the transverse conical portions are protrudingly provided on the front side of the base insulating body along the transverse direction of the base insulating body, each said transverse conical portion has a first end connected to a corresponding said inclined wall of the longitudinal conical portion and extends from the first end toward an opposite second end along the transverse direction of the base insulating body, each said transverse conical portion has two corresponding sides each forming a dividing wall, the dividing walls of each said transverse conical portion have a second common side forming a conical ridge of the each said transverse conical portion and extend from the second common side toward respective opposite sides of the each said transverse conical portion in a sloping manner along the longitudinal direction of the base insulating body, and the conical ridge of each said transverse conical portion is higher than the top ends of the base connection terminals to divide each two adjacent said base connection terminals in a same said row; and two said to-be-pressed-against posts, which are fixed on the base insulating body and are adjacent to two opposite ends of the base insulating body respectively, wherein each said to-be-pressed-against post has an end exposed from the base insulating body; and a connector plug comprising a head insulating body and a plurality of head connection terminals, wherein each said head connection terminal is fixedly provided in the head insulating body and has an end exposed on a front side of the head insulating body, the exposed ends of the head connection terminals are arranged on the head insulating body in a plurality of rows, and the head insulating body comprises:

a longitudinal insertion groove concavely provided in the front side of the head insulating body along a longitudinal direction of the head insulating body to accommodate the plurality of rows of exposed ends of the head connection terminals, wherein the longitudinal insertion groove matches the longitudinal conical portion and the transverse conical portions in configuration in order for a wall of the longitudinal insertion groove to be mounted around the longitudinal conical portion and the transverse conical portions, thereby connecting the connector plug and the connector socket together; and two said elastic clamping plates, which are fixed in the head insulating body and are adjacent to two opposite ends of the head insulating body respectively, wherein each said elastic clamping plate has an end exposed from the head insulating body and corresponding in position to the longitudinal insertion groove;

wherein the end of each said elastic clamping plate presses elastically and tightly against a periphery of a corresponding said to-be-pressed-against post when the connector socket and the connector plug are connected.

2. The signal connector of claim 1, wherein each said row of base connection terminals and an adjacent said row of base connection terminals are arranged in a staggered manner with respect to each other.

3. The signal connector of claim 2, wherein the transverse conical portions between each said row of base connection terminals and the transverse conical portions between an adjacent said row of base connection terminals are arranged in a staggered manner with respect to each other.

4. The signal connector of claim 3, wherein the base connection terminals on a said inclined wall correspond respectively in position to the transverse conical portions on the other inclined wall.

5. The signal connector of claim 4, wherein the conical ridges of the transverse conical portions are as high as the conical ridge of the longitudinal conical portion.

6. The signal connector of claim 5, further comprising a washer mounted in a washer groove concavely provided in a peripheral surface of the base insulating body.

7. The signal connector of claim 6, wherein the base insulating body is penetrated by a plurality of terminal grooves, and each said terminal groove has a top end exposed on a corresponding said inclined wall of the longitudinal conical portion and a bottom end exposed on a bottom portion of the base insulating body in order for the base connection terminals to be inserted into the base insulating body through the terminal grooves respectively.

8. The signal connector of claim 7, wherein each said base connection terminal or each said head connection terminal is provided therein with an elastic element to enable elastic abutment between the end of the each said base connection terminal or of the each said head connection terminal and the end of a corresponding said head connection terminal or of a corresponding said base connection terminal.

9. The signal connector of claim 1, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

10. The signal connector of claim 2, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

11. The signal connector of claim 3, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

12. The signal connector of claim 4, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

13. The signal connector of claim 5, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

14. The signal connector of claim 6, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

15. The signal connector of claim 7, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

16. The signal connector of claim 8, wherein the end of each said base connection terminal and the end of each said head connection terminal have a hemispherical convex shape and a curved concave shape respectively or vice versa to enable secure abutment between the end of each said base connection terminal and the end of a corresponding said head connection terminal.

* * * * *